United States Patent [19]

Minnicino

[11] 3,972,652

[45] Aug. 3, 1976

[54] VARIABLE VOLUME CLEARANCE CHAMBER FOR COMPRESSORS

[75] Inventor: Michael Anthony Minnicino, Allegany, N.Y.

[73] Assignee: Dresser Industries, Inc., Dallas, Tex.

[22] Filed: May 14, 1975

[21] Appl. No.: 577,388

[52] U.S. Cl. ..... 417/277; 92/60.5

[51] Int. Cl.[2] ..... F04B 49/00

[58] Field of Search ..... 417/275, 277; 92/60.5

[56] References Cited

UNITED STATES PATENTS

| | | | |
|---|---|---|---|
| 1,588,256 | 6/1926 | Metzgar | 417/277 |
| 1,867,681 | 7/1932 | Simson | 92/60.5 |
| 2,004,474 | 6/1935 | Schaer | 417/277 |
| 2,197,158 | 4/1940 | Saharoff | 417/277 |

*Primary Examiner*—William L. Freeh
*Assistant Examiner*—G. P. LaPointe
*Attorney, Agent, or Firm*—R. L. Van Winkle; J. N. Hazelwood

[57] ABSTRACT

The improved clearance pocket or chamber for compressors described in this specification includes a hollow housing attached to the cylinder of the compressor. The housing is divided into two clearance chambers and into three power chambers. A valve member located in the housing is movable to provide communication between the compressor cylinder and one or both of the clearance chambers. Movable pistons operably arranged with respect to the valve member are located in the power chambers to position the valve member in the desired position. Suitable fluid power means is connected with the power chambers to cause the desired movement of the pistons.

5 Claims, 4 Drawing Figures

VARIABLE VOLUME CLEARANCE CHAMBER FOR COMPRESSORS

BACKGROUND OF THE INVENTION

This invention relates generally to improved clearance pockets or chambers for compressors. More particularly, but not by way of limitation, this invention relates to an improved variable volume clearance pocket wherein the volume is controlled by fluid means.

Previously proposed arrangements of clearance pockets are illustrated in U.S. Pat. No. 1,867,681 issued July 19, 1932 to A. P. Simson, U.S. Pat. No. 3,084,847 issued Apr. 9, 1963 to S. S. Smith, and U.S. Pat. No. 3,415,441 issued Dec. 10, 1968 to T. K. Kehler. None of the foregoing illustrate an arrangement of clearance pocket that includes structure anticipating the variable volume clearance pocket of this invention. The U.S. Pat. No. 1,867,681 does disclose a clearance pocket having two chambers in which one or both of the clearance chambers can be utilized to vary the volume depending upon the position of a manually positionable valve member. In this respect, the structure of that patent is somewhat similar to the variable clearance pocket of this invention but it does not disclose the fluid controlled means utilized to position the valve member.

An object of this invention is to provide improved variable volume clearance pocket or apparatus for compressors that is controlled by fluid means.

Another object of the invention is to provide an improved variable volume clearance apparatus that can be quickly and easily set to the desired volume without requiring the manual positioning of the valve member.

SUMMARY OF THE INVENTION

This invention provides variable volume clearance apparatus for compressors or the like including a hollow housing connected in communication with a compressor cylinder. The housing includes first and second clearance chambers, a power chamber, a first passageway extending between the compressor cylinder and the first clearance chamber and encircled by a first valve seat, and a second passageway extending between said first and second clearance chambers and encircled by a second valve seat. A valve member located in the first clearance chamber is movable therein into sealing engagement with the first or second valve seat. Fluid pressure control means in communication with the power chamber includes pressure responsive means for selectively positioning the valve member in engagement with the first valve seat wherein neither clearance chamber is in communication with the compressor cylinder, in engagement with the second valve seat wherein the first clearance chamber is in communication with the compressor cylinder, or out of engagement with both of the valve seats wherein both the clearance chambers are in communication with the compressor cylinder.

DETAILED DESCRIPTION OF THE PREFERRED EMBODIMENT

Figure 1:
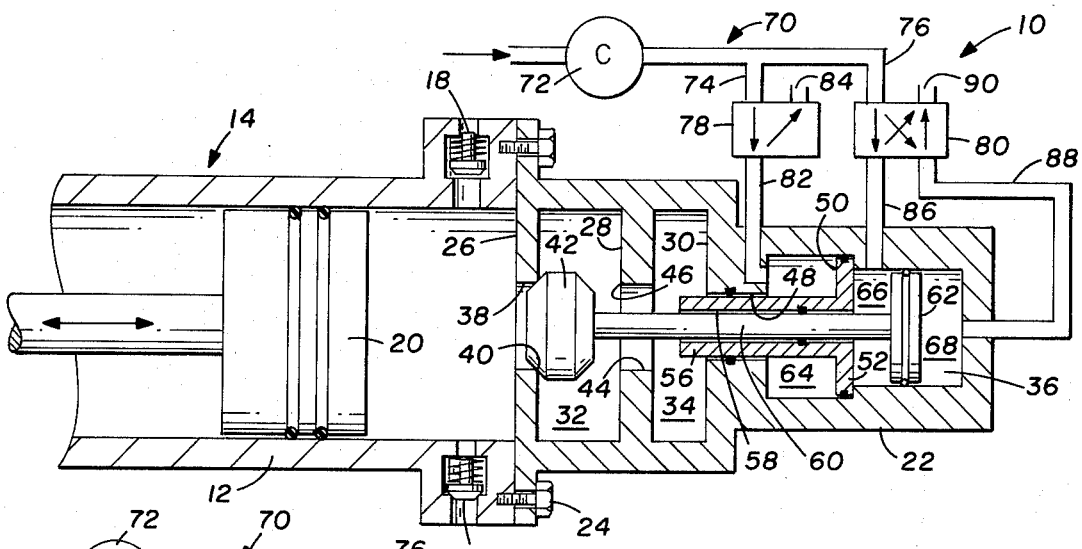
FIG. 1 is a cross-sectional view, partially schematic, that illustrates a portion of a compressor having variable volume clearance apparatus constructed in accordance with the invention connected thereto.

Referring to the drawing and to FIG. 1 in particular, shown therein and generally designated by the reference character 10 is a variable volume clearance apparatus illustrated as being attached to a cylinder 12 of a compressor 14.

In FIG. 1, it can also be seen that the compressor 14 includes inlet and discharge valves 16 and 18, respectively. A piston 18 is mounted in the cylinder 12 for reciprocal movement.

The variable volume clearance apparatus 10 includes a hollow housing 22 that is mounted on the cylinder 12 by means of bolts 24 or otherwise suitably connected thereto. The housing 22 includes spaced partitions 26, 28, and 30 that divide the housing 22 into a first clearance chamber 32, a second clearance chamber 34, and a power chamber 36 that is further subdivided as will be described. A passageway 38 extends through the partition 26 providing fluid communication between the cylinder 12 of the compressor 14 and the first clearance chamber 32. The passageway 38 is encircled by an annular valve seat 40 arranged to sealingly engage a valve member 42 that is located for reciprocating movement in the clearance chamber 32.

An aperture or passageway 44 extends through the partition 28 providing fluid communication between the clearance chamber 32 and the clearance chamber 34. The passageway 44 is also encircled by an annular valve seat 46 that is arranged to sealingly engage the valve member 42.

An aperture 48 extends through the partition 30 connecting the clearance chamber 34 with the power chamber 36. Movably disposed in the power chamber 36 in sealing engagement with the housing 22 is a piston 50 that includes a flange portion 52 and a stem portion 56 that extends in sealing engagement with the housing for engagement with the valve number 42 through the aperture 48. The piston 50 also includes a bore 58 that slidingly and sealingly receives a connecting rod 60 that extends between and connects the valve member 42 with a second piston 62 that is also slidingly located in the power chamber 36 in sealing engagement with the housing 22.

The piston 50 and the partition 30 define a first power area 64. The first piston 50 and the second piston 62 define a second power area 66 and the second piston 62 and the housing 22 define a third power area 68. It will also be noted that the cross-sectional area of the first piston 50 is slightly greater than the cross-sectional area of the second piston 62.

In order to control the position of the valve member 42 and the pistons 50 and 62, the variable volume clearance apparatus 10 is provided with a fluid control system generally designated by the reference character 70. The control system includes a compressor 72 or source of fluid under pressure that is connected by means of conduits 74 and 76 with control valves 78 and 80, respectively. It will be understood that the control valves 78 and 80 may be included in one valve or more than two valves as desired so long as the resulting control is obtained. It should also be pointed out that the control valves can be remotely located, such as in a control panel (not shown), so that the operator can actuate the valves from that position.

The control valve 78 is connected in fluid communication with the first power area 64 by a conduit 82. As illustrated, the control valve 78 can be manipulated to provide compressed air from the compressor 72 to the first power area 64 or to permit air to escape from the first power area 64 therethrough into an exhaust manifold 84.

The control valve 80 is connected in fluid communication with the second power area 66 by a conduit 86 and with the third power area 68 by a conduit 88. The conrtol valve 80 is arranged so that in one position, compressed air is supplied through the conduit 86 to the power chamber 66 and exhausted from the power chamber 68 through an exhaust manifold 90. In another position of the control valve 80, compressed air is supplied through the conduit 88 into the power chamber 68 while air is being exhausted from the power chamber 66 through the conduit 86 and the exhaust manifold 90.

OPERATION OF THE PREFERRED EMBODIMENT

With the compressor 14 operating at is normal capacity, the valve member 42 is positioned as illustrated in FIG. 1. That is, the compressor 72 is operated to supply pressure through the conduit 74 and the conduit 76 to the valves 78 and 80. Air passing through the valve 78 enters the first power area 64 retaining the first piston 50 in the position illustrated. Air passing through the control 80 enters the conduit 88 driving the piston 62 to the left as seen in FIG. 1 and by virtue of the connecting rod 60, moves the valve member 42 into sealing engagement with the valve seat 40 to close the passageway 38. Thus, the compression valve available in the compressor 14 is limited to the volume between the compressor piston 20 and the first partition 26.

Figure 2:
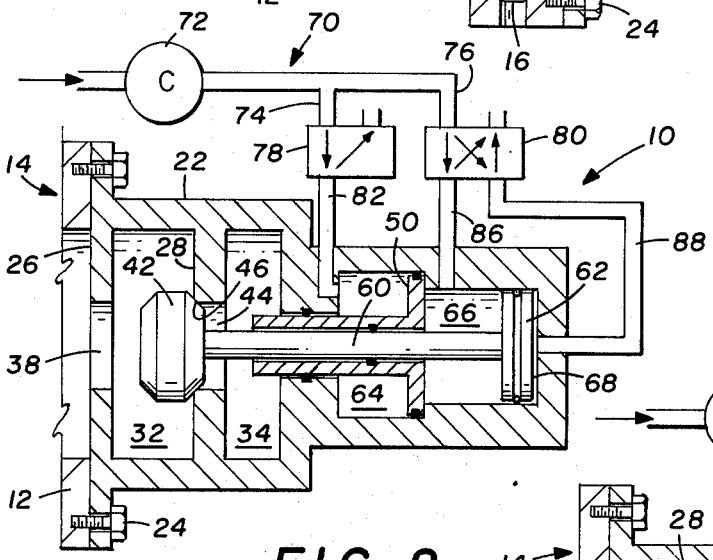
FIG. 2 is a view similar to FIG. 1, but illustrating the variable volume clearance apparatus in another operating position.

Should it become desirable or necessary to change the volumetric capacity of the compressor 14 during operation, the position of the control valve 80 is changed so that the compressed air being delivered by the compressor 72 flows through the conduit 86 into the second power area 66 and outwardly of the third power area 68 through the conduit 88 where it is exhausted from the control valve 80. A pressure differential in this direction causes the piston 62 to be driven to the right as illustrated in FIG. 2. By virtue of the connecting rod 60, the valve member 42 is also carried to the right until it sealingly engages the valve seat 46 surrounding the passageway 44 in the second partition 28. In this condition, it will be appreciated that the cylinder 12 of the compressor 14 is now in communication through the passageway 38 with the first clearance chamber 32. Thus, more volume is disposed ahead of the compressor piston 22 resulting in the change of the volumetric capacity of the compressor.

Figure 3:
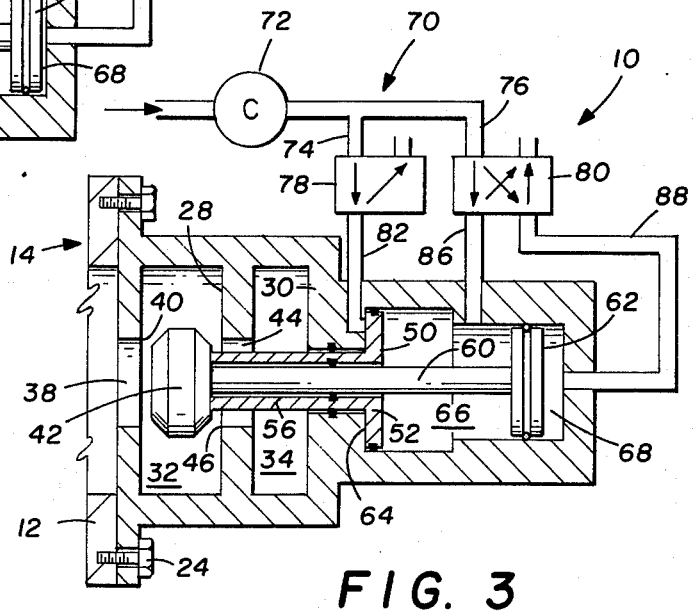
FIG. 3 is a view similar to FIG. 2, but illustrating the variable volume clearance apparatus in still another operating position.

A further change in the volumetric capacity can be made as and when desired by shifting the position of the control valve 78 while retaining the previously described position of the control valve 80. It will be seen that compressed air is supplied through the control valve 80 and the conduit 86, entering the power area 66 between the pistons 50 and 62. Simultaneously, air is discharged from the power area 64 through the conduit 82 and outwardly of the control valve 78 while air from the power area 68 is discharged through the conduit 88 and outwardly of the control valve 80. In this position, as illustrated in FIG. 3, the piston 50 is displaced to the left until the stem portion 56 thereof engages the valve member 42. Since the piston 50 has a greater area than the area of the piston 62, the overall effect is to displace the piston 62, connecting rod 60, and the valve member 42 to the left until flange portion 52 of the piston 50 engages the partition 30 at which time movement is arrested. In this position, the valve member 42 is not in engagement with either the valve seat 40 or the valve seat 46 and thus permits fluid communication through the passageway 38 into the first clearance chamber 32 and through the passageway 44 into the second clearance chamber 34. Accordingly, the volumetric capacity of the compressor 14 is again changed since the compressor cylinder 12 above the piston 20 is now in communication with both of the clearance chambers 32 and 34.

DESCRIPTION OF THE EMBODIMENT OF FIG. 4

Figure 4:
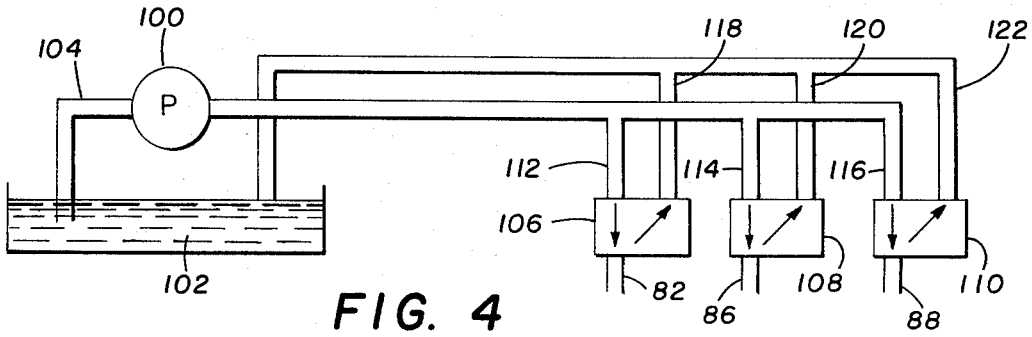
FIG. 4 is a schematic view illustrating another embodiment of fluid control apparatus that is also constructed in accordance with the invention.

FIG. 4 illustrates another embodiment of control system that can be utilized with the variable volume clearance apparatus illustrated in FIGS. 1–3. The embodiment of FIG. 4 utilizes a hydraulic pump 100 that is connected in fluid communication with a reservoir 102 by a conduit 104. The pump is connected with control valves 106, 108, and 110 by supply conduits 112, 114, and 116, respectively. The control valves 106, 108, and 110 are also connected in communication with the reservoir 102 by return conduits 118, 120, and 122, respectively. It will be understood that the control valve 106 is connected with the first power area 64 via the conduit 82. The control valve 108 is connected with the second power area 66 by the conduit 86 and the third control valve 110 is connected to the third power area 68 by the conduit 88. As previously mentioned with respect to the control valves 78 and 80, the control valves 106, 108, and 110 may be combined into one valve if desired. Also, these valves may be located at a remote position such as in a control panel (not shown) so that the variations in the capacity can be made without being physically located at the compressor.

To operate the variable volume clearance apparatus with the hydraulic control system connected thereto, hydraulic fluid is supplied through the conduit 112 and control valve 106 into the first power area 64 to retain the piston 50 in the position illustrated in FIG. 1. Fluid is also supplied through the third control valve 110, the conduit 116, and the conduit 88 into the third power area 68 to drive the piston 62 and the connected valve member 42 against the valve seat 40 closing the passageway 38 and preventing communication between the compressor cylinder 12 and the first clearance chamber 32. Simultaneously, the second control valve 108 is positioned so that fluid is discharged from the second power area 66 through the conduit 86, the control valave 108, and the return conduit 120 to the reservoir 102.

To place the valve member 42 in the position illustrated in FIG. 2, that is in a position wherein the first clearance chamber 32 is in fluid communication with the compressor cylinder, the control valves 108 and 110 are repositioned so that fluid is now supplied through the conduit 114, control valve 108, and the conduit 86 into the second power area 66 driving the piston 62 and connected valve member 42 to the right until the valve member 42 sealingly engages the seat 46 as illustrated in FIG. 2. Hydraulic fluid is discharged from the third power area 68 through the conduit 88, control valve 110, and to the reservoir 102 through the return conduit 122.

To operate the system so that the valve member 42 is not in engagement with either of the valve seats 40 or 46 as shown in FIG. 3, the control valve 106 is positioned so that fluid is discharged from the first power area 64 through the conduit 82, the control valve 106, and to the reservoir 102 through the return conduit 118. The control valve 108 is also positioned so that hydraulic fluid is supplied through the conduit 114, the control valve 108, and the conduit 86 into the second power area 66 driving the piston 50 to the left until the flange 52 thereon engages the partition 30. Simultaneously, the third control valve 110 is positioned as mentioned in connection with the description of FIG. 2 so that fluid is discharged from the third power area 68. The effect is that the fluid pressure in the second power area 66 tends to drive the piston 62 to the right bringing the valve member 42 in engagement with the piston 50. As previously mentioned, the piston 50 has a greater area than the piston 62 which provides sufficient force to hold the valve member 42 off the seat 46 and off the seat 40 due to the engagement of the piston 50 with the partition 30. In this position, it will be seen that the cylinder 12 of the compressor 14 is in fluid communication with both the clearance chambers 32 and 34 as previously mentioned in connection with the description of FIG. 3.

The embodiments described in detail hereinbefore clearly demonstrate a relatively simple means of remotely controlling and of providing an improved variable volume clearance apparatus for compressors. It will be understood that the detailed descriptions are presented by way of example only and that many changes and modifications can be made thereto without departing from the spirit or scope of the invention.

The embodiments of the invention in which an exclusive property or privilege is claimed are defined as follows:

1. Variable volume clearance apparatus for compressors or the like that include a compressor cylinder and inlet and outlet valves for the cylinder, comprising:

a hollow housing connected in communication with the compressor cylinder, said housing including first and second clearance chambers, a power chamber, a first passageway extending between the cylinder and first clearance chamber and encircled by a first valve seat, and a second passageway extending between said first and second clearance chambers and encircled by a second valve seat;

a valve member located in said first clearance chamber and movable therein into sealing engagement with said first or second valve seat;

fluid pressure control means in fluid communication with said power chamber and including pressure-responsive means for selectively positioning said valve member in engagement with said first valve seat wherein neither clearance chamber is in communication with the compressor cylinder, in engagement with said second valve seat wherein said first clearance chamber is in communication with the compressor cylinder, or out of engagement with both said valve seats wherein both said clearance chambers are in communication with the compressor cylinder, said pressure-responsive means including a first pressure-responsive piston movably located in said power chamber, connection means operably joining said piston and valve member for joint movement, and a second pressure-responsive piston movably located in said power chamber and having an extended portion thereon for engaging said valve member.

2. Variable volume clearance apparatus for compressors or the like that include a compressor cylinder and inlet and outlet valves for the cylinder, comprising:

a hollow housing connected in communication with the compressor cylinder, said housing including first and second clearance chambers, a power chamber, a first passageway extending between the cylinder and first clearance chamber and encircled by a first valve seat, a second passageway extending between said first and second clearance chambers and encircled by a second valve seat, and an aperture extending between said first power chamber and second clearance chamber;

a valve member located in said first clearance chamber and movable therein into sealing engagement with said first or second valve seat;

a first pressure-responsive piston movably located in said power chamber;

connection means operably joining said piston and valve member for joint movement;

a second pressure-responsive piston movably located in said power chamber and having an extended portion thereon for engaging said valve member;

first, second and third pressure areas defined in said power chamber by said pistons; and fluid pressure control means in fluid communication with said pressure area for selectively pressuring said pressure areas, whereby fluid pressure in said first pressure area moves said valve member into engagement with said first valve seat closing both said clearance chambers, fluid pressure in said second and third pressure areas moves said valve member into engagement with said second valve seat opening said first clearance chamber to the compressor cylinder and closing said second clearance chamber, and fluid pressure in said second pressure area moves said second piston into engagement with said valve member retaining said valve member off both said valve seats opening both clearance pockets to the compressor cylinder.

3. The apparatus of claim 2 wherein said second piston includes a bore slidingly receiving said first piston and the extended portion on said second piston is slidingly disposed in said aperture.

4. The apparatus of claim 3 and also including:

first seal means for forming a fluid-tight seal between said first piston and said housing in said power chamber;

second seal means for forming a fluid-tight seal between said second piston and said housing in said chamber;

third seal means for forming a fluid-tight seal between said pistons; and, fourth seal means for forming a fluid-tight seal between said second piston and said housing in said aperture.

5. The apparatus of claim 4 wherein said fluid pressure control means includes:

conduit means arranged for connection with a fluid pressure source and connected in fluid communication with each said pressure area; and, valve means operably disposed in said conduit means for selectively controlling the flow of pressure fluid to and from said pressure areas.

* * * * *